US007484554B2

(12) United States Patent
Lai et al.

(10) Patent No.: US 7,484,554 B2
(45) Date of Patent: Feb. 3, 2009

(54) HEAT EXCHANGING DEVICE

(76) Inventors: Herman Lai, No. 25, Dajin Street, Nantun, Taichung 40864 (TW); Bin Juen Huang, No. 7, Lane 52, Wunjou Street, Taipei 10660 (TW)

( * ) Notice: Subject to any disclaimer, the term of this patent is extended or adjusted under 35 U.S.C. 154(b) by 557 days.

(21) Appl. No.: 11/106,985

(22) Filed: Apr. 15, 2005

(65) Prior Publication Data

US 2006/0237170 A1 Oct. 26, 2006

Related U.S. Application Data

(63) Continuation-in-part of application No. 10/042,424, filed on Jan. 10, 2002, now abandoned.

(51) Int. Cl.
*F24H 3/02* (2006.01)

(52) U.S. Cl. ..... 165/121; 165/120; 165/163

(58) Field of Classification Search ..... 165/120, 165/121, 122, 140, 63, 64, 163
See application file for complete search history.

(56) References Cited

U.S. PATENT DOCUMENTS 2,783,623 A * 3/1957 Dodge ..... 165/124
3,263,748 A 8/1966 Jemal et al.
4,248,209 A 2/1981 Wasserman ..... 126/417
4,357,910 A * 11/1982 Blockley et al. ..... 165/163
4,556,103 A * 12/1985 Kuwa et al. ..... 165/122
6,123,147 A 9/2000 Pittman ..... 165/228

* cited by examiner

*Primary Examiner*—Ljiljana (Lil) V Ciric
(74) *Attorney, Agent, or Firm*—Charles E. Baxley

(57) ABSTRACT

A heat exchanging device includes a receptacle having a chamber for receiving a fluid medium, a housing received within the receptacle and having an outer peripheral wall arranged to allow the fluid medium to flow into the housing via the upper portion of the outer peripheral wall, and having an inner peripheral wall having a lower portion directed toward the lower portion of the receptacle. A circulating device may circulate the fluid medium to flow from the upper portion of the housing and then toward the lower portion of the receptacle. A coil is arranged to have a fluid material to flow in a direction opposite to that of the fluid medium, to allow the fluid medium to transmit and to release heat to the fluid material.

5 Claims, 4 Drawing Sheets

HEAT EXCHANGING DEVICE

The present invention is a continuation-in-part of U.S. patent application Ser. No. 10/042,424, filed 10 Jan. 2002, abandoned.

BACKGROUND OF THE INVENTION

1. Field of the Invention

The present invention relates to a heat exchanging device, and more particularly to a heat exchanging device having a confined relatively smaller heat exchanging housing for increasing the heat exchanging effect for the heat exchanging device.

2. Description of the Prior Art

Typical heat exchanging devices comprise an outer receptacle for receiving the water or the fluid material to be heated therein, and a paddling device for moving or paddling the water or the fluid material to flow through a heat exchanging housing or the like.

For example, U.S. Pat. No. 3,263,748 to Jemal et al. discloses one of the typical heat exchanging devices comprising a rotary conveyor heat exchange device disposed within a housing, for pumping or circulating the water or the fluid material. However, the housing is disposed laterally or horizontally, such that the rotary conveyor heat exchange device may not be used to force the cold water downwardly toward the lower portion of the housing, or may not be used to circulate the water upwardly and downwardly within the housing.

U.S. Pat. No. 4,248,209 to Wasserman discloses another typical heat exchanging device comprising a number of tubes filled within the hollow interiors of a number of tires. However, the tires are not sealingly secured together, such that the tubes may also be communicated with the water or the fluid material received within an outer receptacle. The typical heat exchange device also may not be used to circulate the water or the fluid material upwardly and downwardly within the outer receptacle.

U.S. Pat. No. 6,123,147 to Pittman discloses a further typical heat exchanging device comprising a coil received within an outer receptacle. However, the coil is laterally or horizontally disposed within the outer receptacle, and also may not be used to circulate the water or the fluid material upwardly and downwardly within the outer receptacle.

The present invention has arisen to mitigate and/or obviate the afore-described disadvantages of the conventional heat exchanging devices.

SUMMARY OF THE INVENTION

The primary objective of the present invention is to provide a heat exchanging device including a confined relatively smaller heat exchanging housing received within an outer receptacle, for limiting or guiding the water or the fluid material to flow upwardly and downwardly within the housing, and for increasing the heat exchanging effect for the heat exchanging device.

In accordance with one aspect of the invention, there is provided a heat exchanging device comprising a receptacle including a chamber for receiving a fluid medium therein, and having a lower portion, a middle portion and an upper portion, a housing received within the chamber of the receptacle, and including an outer peripheral wall having an upper portion arranged to allow the fluid medium to flow into the housing via the upper portion of the outer peripheral wall, and including an inner peripheral wall having a lower portion directed toward the lower portion of the receptacle, a circulating-device for circulating the fluid medium to flow from the upper portion of the outer peripheral wall toward the lower portion of the inner peripheral wall of the housing and then toward the lower portion of the receptacle, and a coil arranged between the outer peripheral wall and the inner peripheral wall of the housing, for receiving a fluid material, and arranged to have the fluid material to flow in a direction opposite to that of the fluid medium, to allow the fluid medium to transmit and to exchange heat to the fluid material.

The circulating device includes a casing disposed within the housing and having an outlet port coupled to an inner compartment of the inner peripheral wall of the housing, and having an inlet opening for receiving the fluid medium and to allow the fluid medium to flow into the casing via the inlet opening and then to into the casing and then to flow out through outlet port of the flow out through the outlet port of the casing.

The circulating device includes a first paddling device disposed within the casing, for paddling the fluid medium to flow into the casing and then to flow out through the outlet port of the casing. The casing includes a partition disposed therein, to separate the casing into separated first and second chambers, the first paddling device is disposed within the first chamber of the casing.

The casing includes an entrance and an exit communicating with the second chamber of the casing, the exit is coupled to the coil. The casing includes a second paddling device disposed within the second chamber of the casing, and coupled to the first paddling device, to allow the first and the second paddling devices to be rotated in concert with each other. The partition includes a shaft disposed therein, and coupled to the first and the second paddling devices.

The housing includes an intermediate wall disposed between the outer peripheral wall and the inner peripheral wall of the housing, to form an outer peripheral space and an inner peripheral space between the outer and the intermediate and the inner peripheral walls of the housing.

The housing includes a bottom wall coupled between a lower portion of the outer peripheral wall and the inner peripheral wall, to guide the fluid medium to flow from the outer peripheral space of the housing, beyond a lower portion of the intermediate wall, and then to flow into the inner peripheral space of the housing. The coil includes an inner portion engaged within the inner peripheral space of the housing, and an outer portion engaged within the outer peripheral space of the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 3:
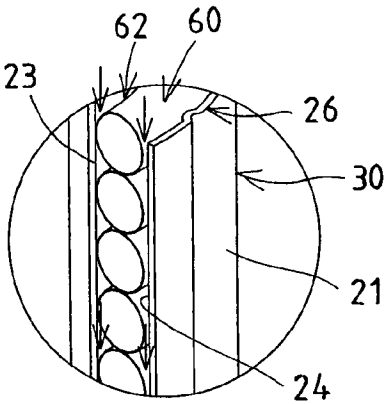
FIGS. 2, 3 are enlarged partial perspective views of the heat exchanging device.

Referring to the drawings, and initially to FIGS. 1-5, a heat exchanging device in accordance with the present invention comprises an outer receptacle 10 including a hollow interior or a chamber 11 formed therein for receiving a heat or fluid medium 90, such as water, air or other fluid medium 90 therein, and including a lower portion 12, an intermediate or middle portion 13, and an upper portion 14.

A housing 20 includes an outer size or diameter or contour smaller than that of the outer receptacle 10, for being received within the chamber 11 of the outer receptacle 10, and includes an outer peripheral wall 21, an inner peripheral wall 22, and an intermediate or middle peripheral wall 23 disposed between the outer and the inner peripheral walls 21, 22, to form or define two annular or peripheral spaces 24, 25 between the walls 21, 22, 23 respectively.

Figure 1:
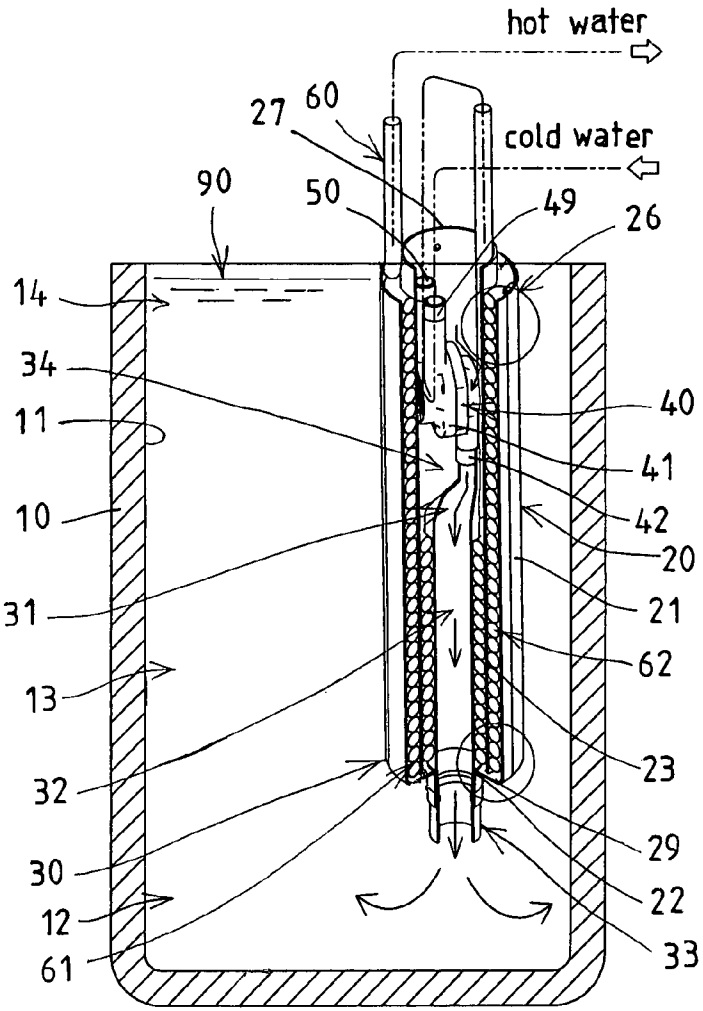
FIG. 1 is a partial cross sectional view of a heat exchanging device in accordance with the present invention.
Figure 4:
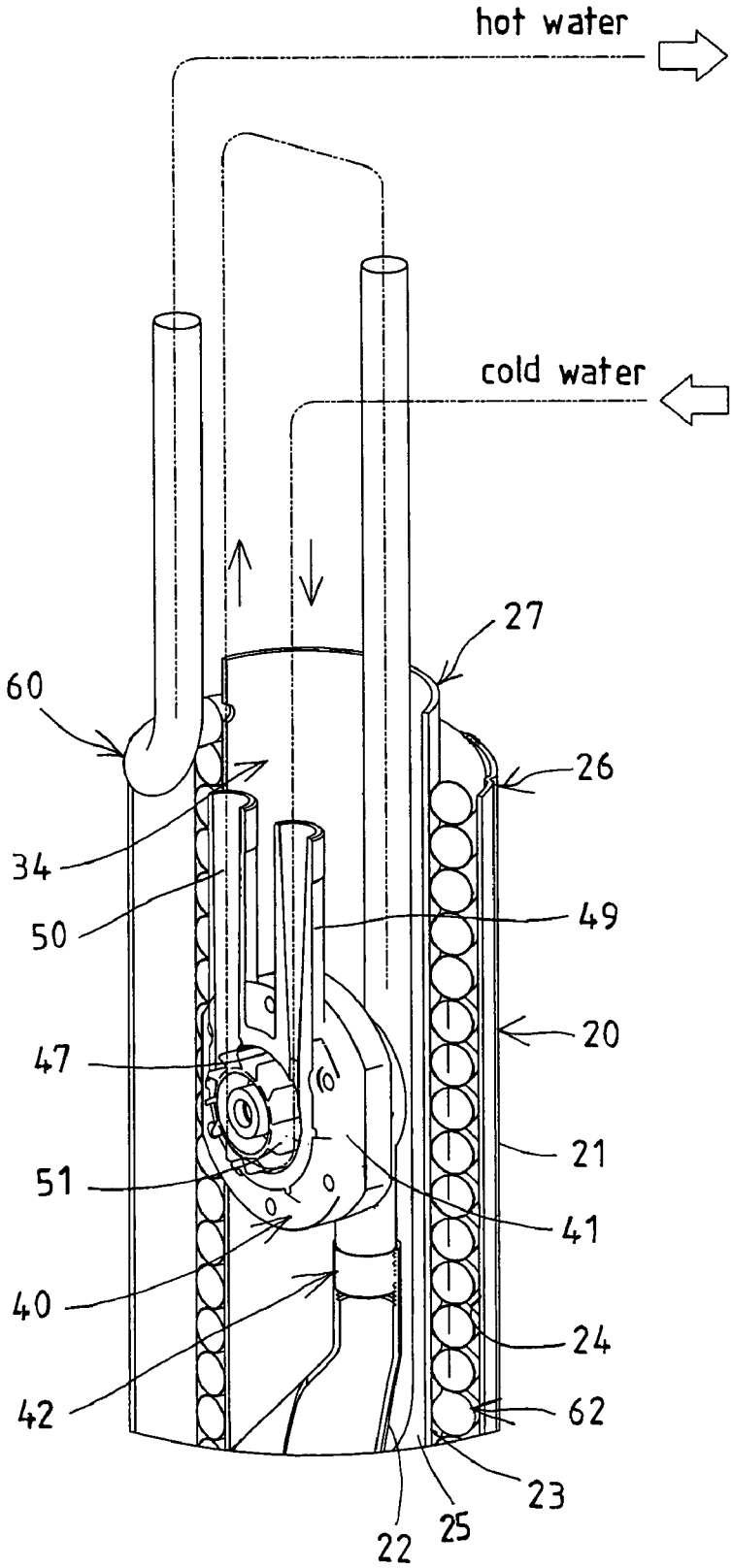
FIG. 4 is another enlarged partial perspective view of the heat exchanging device.
Figure 5:
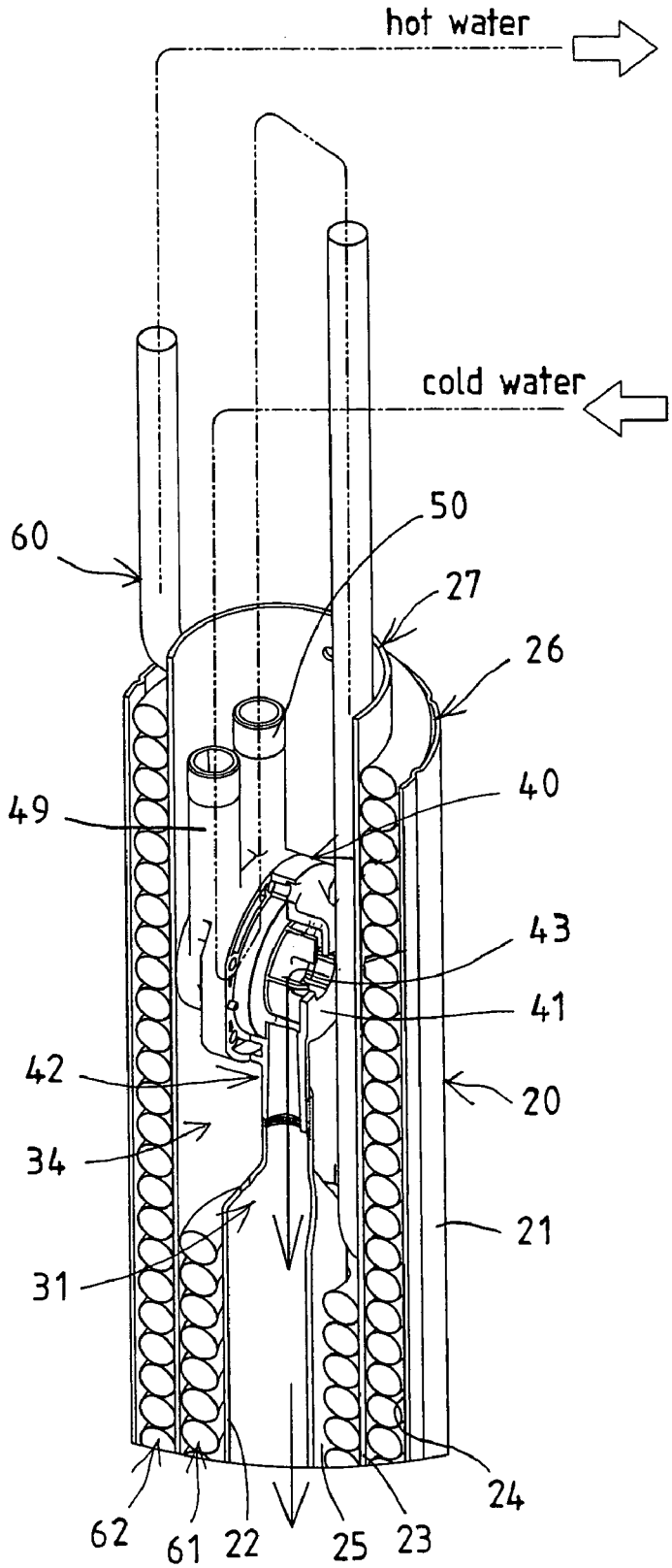
FIG. 5 is a further enlarged partial perspective view of the heat exchanging device, as seen from a direction opposite to that shown in FIG. 4.

The outer peripheral wall 21 of the housing 20 includes an upper portion 26 slightly lower than the fluid level of the fluid medium or the water or the fluid medium 90, best shown in FIGS. 1 and 3, to allow the fluid medium 90 to flow beyond the upper portion 26 of the outer peripheral wall 21 of the housing 20, and to allow the fluid medium 90 to flow into the outer peripheral space 24 of the housing 20.

The intermediate wall 23 includes an upper portion 27 slightly higher than the fluid level of the fluid medium or the water or the fluid medium 90, to prevent the fluid medium 90 from flowing beyond the upper portion 27 of the intermediate wall 23 of the housing 20, and to limit and to guide the fluid medium 90 to flow downwardly toward the lower portion of the outer peripheral space 24 of the housing 20.

Figure 2:
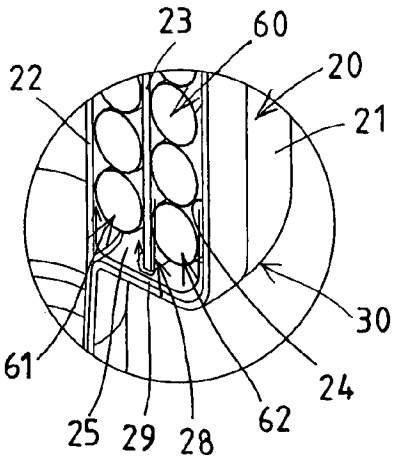

However, the intermediate wall 23 includes a lower portion 28 slightly spaced away from a bottom wall 29 that is coupled between the lower portion 30 of the outer peripheral wall 21 and the inner peripheral wall 22, to allow the fluid medium 90 to flow from the outer peripheral space 24 of the housing 20, and to flow downwardly beyond the lower portion 28 of the intermediate wall 23, and then to flow into the inner peripheral space 25 of the housing 20, best shown in FIG. 2.

The inner peripheral wall 22 includes an upper portion 31 arranged lower than the upper portion 26 of the outer peripheral wall 21 of the housing 20 (FIGS. 1, 5), to allow the fluid medium 90 to flow into the inner compartment 32 of the inner peripheral wall 22 of the housing 20; and includes a lower portion 33 extended or directed toward the lower portion 12 of the outer receptacle 10, to guide or to limit the fluid medium 90 to flow toward the lower portion 12 of the outer receptacle 10 (FIG. 1).

A pumping or circulating means or device 40 includes a casing 41 disposed within the housing 20, such as disposed within the interior 34 of the intermediate wall 23 of the housing 20, and preferably having an outlet port 42 coupled to the upper portion 31 of the inner compartment 32 or of the inner peripheral wall 22 of the housing 20; and includes an inlet opening 43 formed therein and communicating with the interior 34 of the intermediate wall 23 of the housing 20, to allow the fluid medium 90 to flow into the casing 41 of the circulating means or device 40 via the inlet opening 43, and then to flow out of the casing 41 through the outlet port 42 of the casing 41.

The circulating means or device 40 further includes a fan or paddling device 44 disposed within the casing 41, for circulating or drawing the fluid medium 90 to flow into the casing 41 via the inlet opening 43, and then to flow out through the outlet port 42 of the casing 41, and then to force the fluid medium 90 to flow into the inner compartment 32 or the inner peripheral wall 22 of the housing 20, and then to flow downwardly toward the lower portion 12 of the outer receptacle 10.

Figure 6:
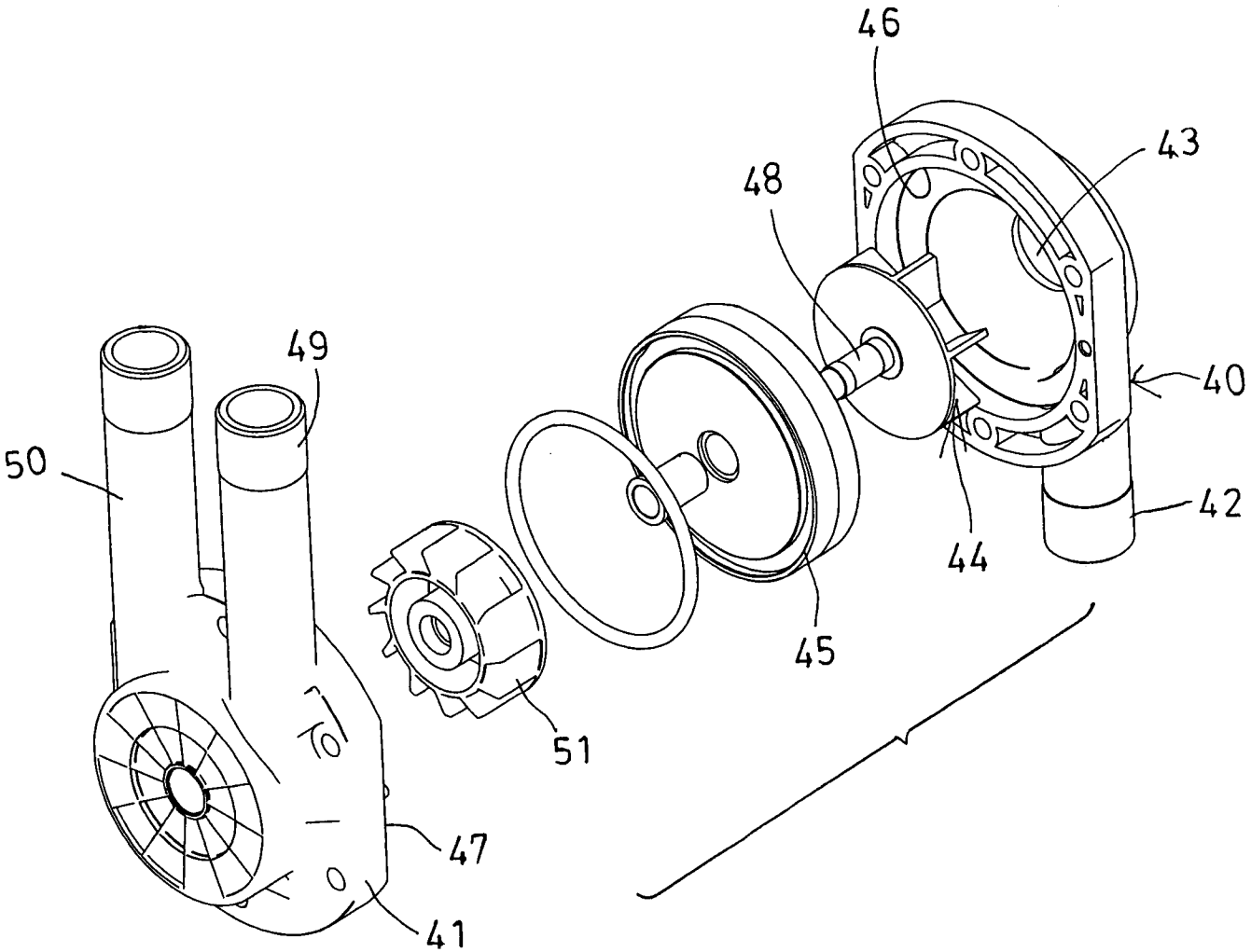
FIG. 6 is a partial exploded view of the heat exchanging device.

It is preferable that the casing 41 includes a partition 45 disposed therein, to separate the inner portion of the casing 41 into two separated chambers 46, 47 (FIGS. 4, 6), and a shaft 48 secured to the paddling device 44 and rotatably attached to the partition 45, to rotatably attach or support the paddling device 44 within the casing 41. The paddling device 44 is rotatably received within one of the chambers 46 of the casing 41.

The casing 41 further includes an entrance 49 for coupling to a reservoir, for receiving cold water or the other or the fluid material from the reservoir, and an exit 50 for coupling to a coil 60, and for heat exchanging purposes. The entrance 49 and the exit 50 of the casing 41 are communicating with the other chamber 47 of the casing 41, for allowing the cold water to flow into the other chamber 47 of the casing 41 via the entrance 49, and then to flow out through the exit 50 of the casing 41.

The circulating means or device 40 further includes a follower or another fan or paddling device 51 disposed within the other chamber 47 of the casing 41, for being actuated or rotated by the water or the fluid material that flows into the other chamber 47 of the casing 41 via the entrance 49 and then flows out through the exit 50 of the casing 41 and then flows into the coil 60, and for heat exchanging purposes. It is preferable that the paddling device 51 is also secured to the shaft 48 and rotated in concert with the paddling device 44. However, the paddling device 51 may also be separated from the paddling device 44 and powered by the other energy or force.

It is preferable that the coil 60 includes an inner coil portion 61 engaged within the inner peripheral space 25 of the housing 20, and an outer coil portion 62 engaged within the outer peripheral space 24 of the housing 20, for heat exchanging with the fluid medium 90 flowing through the outer and the inner peripheral spaces 24, 25 of the housing 20, and thus for allowing the heat of the fluid medium 90 to be transmitted to the water or the fluid material, and to form or to generate or to output hot water.

In operation, as shown in FIG. 1, when the cold water or the fluid material is supplied into the other chamber 47 of the casing 41 via the entrance 49 and then to flow out through the exit 50 of the casing 41, and then to flow into the coil 60, the water or the fluid material may force or actuate or rotate the paddling device 51 and thus the paddling device 44, in order to draw or to pump the fluid medium 90 to flow into the casing 41 of the circulating means or device 40 via the inlet opening 43, and then to flow out through the outlet port 42 of the casing 41.

The paddling device 44 of the circulating means or device 40 is disposed within one of the chambers 46 of the casing 41, and is provided for pumping the fluid medium 90 to flow into the casing 41, and then to flow into the inner compartment 32 or the inner peripheral wall 22 of the housing 20, and then to allow the fluid medium 90 that has released heat to flow downwardly toward the lower portion 12 of the outer receptacle 10.

It is further to be noted that the hotter fluid medium 90 may flow upwardly toward or within the upper portion 14 of the outer receptacle 10, and may be drawn into the outer peripheral space 24 of the housing 20 and then into the inner peripheral space 25 of the housing 20, and then into the inner compartment 32 or the inner peripheral wall 22 of the housing 20.

On the contrary, the water or the fluid material flowing through the coil 60 may firstly flow through the inner peripheral space 25 of the housing 20, and then into the outer peripheral space 24 of the housing 20, in a flowing direction opposite to that of the fluid medium 90, for allowing the heat of the fluid medium 90 to be effectively transferred to the fluid material flowing through the coil 60, and to have the water or the fluid material to flow out of the coil 60 as hot water or hot fluid material.

Normally, the hotter fluid medium 90 may flow upwardly toward or within the upper portion 14 of the outer receptacle 10 due to convection of heat. In addition, after heat exchanging or heat transferring to the fluid material that flows through the coil 60, the temperature of the fluid medium 90 may be decreased and may flow downwardly toward the lower portion 12 of the outer receptacle 10, and thus to allow the hotter fluid medium 90 to be maintained within the upper portion 14 of the outer receptacle 10, and the colder fluid medium 90 to be maintained within the lower portion 12 of the outer receptacle 10, and the warm fluid medium 90 to be maintained within the middle portion 13 of the outer receptacle 10.

Accordingly, the heat exchanging device in accordance with the present invention includes a confined relatively smaller heat exchanging housing received within an outer receptacle, for limiting or guiding the water or the fluid material to flow upwardly and downwardly within the housing, and for increasing the heat exchanging effect for the heat exchanging device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A heat exchanging device comprising:

a receptacle including a chamber for receiving a fluid medium therein, and having a lower portion, a middle portion and an upper portion, a housing received within said chamber of said receptacle, and including an outer peripheral wall having an upper portion arranged to allow the fluid medium to flow into said housing via said upper portion of said outer peripheral wall, and including on inner peripheral wall having a lower portion directed toward said lower portion of said receptacle, a casing disposed within said housing and including an outlet port coupled to an inner compartment of said inner peripheral wall of said housing, and including an inlet opening for receiving the fluid medium and to allow the fluid medium to flow through said inlet opening and to flow into said casing and then to flow out through said outlet port of said casing, and including a partition disposed in said casing to form separated first and second chambers in said casing, and including an entrance and an exit communicating with said second chamber of said casing, a first paddling device disposed within said first chamber of said casing for paddling the fluid medium to flow into said casing and then to flow out through said outlet port of said casing, a second padding device disposed within said second chamber of said casing and coupled to said first paddling device to allow said first and said second paddling devices to be rotated in concert with each other, and a coil arranged between said outer peripheral wall and said inner peripheral wall of said housing, and coupled to said exit of said casing for receiving a fluid material, and arranged to have the fluid material to flow in a direction opposite to that of the fluid medium, to allow the fluid medium to transmit and to exchange heat to the fluid material.

2. The heat exchanging device as claimed in claim 1, wherein said partition includes a shaft disposed therein, and coupled to said first and said second peddling devices.

3. The heat exchanging device as claimed in claim 1, wherein said housing includes an intermediate wall disposed between said outer peripheral wall and said inner peripheral wall of said housing, to form an outer peripheral space between said outer peripheral wall and said intermediate wall and an inner peripheral space between said intermediate wall and said inner peripheral wall of said housing.

4. The heat exchanging device as claimed in claim 3, wherein said housing includes a bottom wall coupled between a lower portion of said outer peripheral wall and said inner peripheral wall, to guide the fluid medium to flow from said outer peripheral space of said housing, beyond a lower portion of said intermediate wall, and then to flow into said inner peripheral space of said housing.

5. The heat exchanging device as claimed in claim 3, wherein said coil includes an inner portion engaged within said inner peripheral space at said housing, and an outer portion engaged within said outer peripheral space of said housing.

* * * * *